US010777181B2

(12) United States Patent
Topel et al.

(10) Patent No.: US 10,777,181 B2
(45) Date of Patent: Sep. 15, 2020

(54) MODULATED ELECTROMAGNETIC MUSICAL SYSTEM AND ASSOCIATED METHODS

(71) Applicant: THE TRUSTEES OF DARTMOUTH COLLEGE, Hanover, NH (US)

(72) Inventors: Spencer Topel, Hanover, NH (US); Herbert H. C. Chang, Kaohsiung (TW)

(73) Assignee: THE TRUSTEES OF DARTMOUTH COLLEGE, Hanover, NH (US)

( * ) Notice: Subject to any disclaimer, the term of this patent is extended or adjusted under 35 U.S.C. 154(b) by 0 days.

(21) Appl. No.: 16/316,347

(22) PCT Filed: Jul. 10, 2017

(86) PCT No.: PCT/US2017/041403
§ 371 (c)(1),
(2) Date: Jan. 8, 2019

(87) PCT Pub. No.: WO2018/013491
PCT Pub. Date: Jan. 18, 2018

(65) Prior Publication Data

US 2019/0304425 A1 Oct. 3, 2019

Related U.S. Application Data

(60) Provisional application No. 62/360,445, filed on Jul. 10, 2016.

(51) Int. Cl.
*G10H 3/22* (2006.01)
*G10H 3/26* (2006.01)
(Continued)

(52) U.S. Cl.
CPC ..... *G10H 3/22* (2013.01); *G10F 1/18* (2013.01); *G10G 1/04* (2013.01); *G10H 1/0058* (2013.01);
(Continued)

(58) Field of Classification Search
CPC ..... G10H 3/22; G10H 3/26; G10H 2220/461
See application file for complete search history.

(56) References Cited

U.S. PATENT DOCUMENTS 3,327,043 A * 6/1967 Martin ..... G10H 1/0091 84/642
3,418,417 A * 12/1968 Rhodes ..... G10H 3/20 84/743
(Continued)

OTHER PUBLICATIONS

International Search Report and Written Opinion of PCT/US2017/041403 dated Sep. 28, 2017, 6 pp.
(Continued)

*Primary Examiner* — Jeffrey Donels
(74) *Attorney, Agent, or Firm* — Lathrop GPM LLP

(57) ABSTRACT

A modulated electromagnetic musical instrument and sound reproduction system includes an acoustic carrier signal source, a modulation signal source, a linkage element, and an acoustic output. The acoustic carrier signal source is produced electromagnetically or mechanically via human instrument playing. An electromagnetic modulation source mixes with the acoustic carrier signal within a linkage element to produce a nonlinear behavior. This nonlinear behavior's coupled interaction with a physical medium or acoustic body produces sideband frequency components to form unique musical sound outputs and audio effects.

18 Claims, 11 Drawing Sheets

(51) Int. Cl.

| | |
|---|---|
| ***G10F 1/18*** | (2006.01) |
| ***G10H 3/14*** | (2006.01) |
| ***G10H 3/20*** | (2006.01) |
| ***G10G 1/04*** | (2006.01) |
| ***G10H 1/00*** | (2006.01) |
| ***G10H 5/02*** | (2006.01) |
| ***G10H 3/18*** | (2006.01) |

(52) U.S. Cl.
CPC ..... *G10H 3/143* (2013.01); *G10H 3/146* (2013.01); *G10H 3/18* (2013.01); *G10H 3/20* (2013.01); *G10H 3/26* (2013.01); *G10H 5/02* (2013.01); *G10H 2220/461* (2013.01)

(56) References Cited

U.S. PATENT DOCUMENTS 4,018,121 A * 4/1977 Chowning ..... G10H 1/02 84/696
5,824,927 A 10/1998 Tonon
6,034,316 A * 3/2000 Hoover ..... G10H 3/186 84/738
6,049,034 A * 4/2000 Cook ..... G10H 5/007 84/659
7,638,704 B2 12/2009 Ludwig
7,777,118 B2 * 8/2010 Stoneback ..... G10H 1/0091 84/291
7,777,119 B2 * 8/2010 Stoneback ..... G10H 3/26 84/291
7,777,120 B2 * 8/2010 Stoneback ..... G10H 1/0091 84/291
2004/0007116 A1 1/2004 Marcus
2007/0017344 A1 * 1/2007 Stoneback ..... G10H 1/0091 84/600
2007/0017345 A1 * 1/2007 Stoneback ..... G10H 3/26 84/600
2007/0214940 A1 * 9/2007 Stoneback ..... G10H 1/0091 84/600
2010/0312495 A1 12/2010 Haviland et al.

OTHER PUBLICATIONS

International Preliminary Report on Patentability of PCT/US2017/041403 dated Jan. 15, 2019, 6 pp.

* cited by examiner

600

Third-Order Transfer Function Expansion

Frequency Components and their amplitudes

| | |
|---|---|
| Fundamental term | $(K_1A + {}^3/_2K_3AB^2 + {}^3/_4A^3)\cos\omega_a t$<br>$(K_1B + {}^3/_2K_3A^2B + {}^3/_4B^3)\cos\omega_b t$ |
| $2^{nd}$ Harmonic Term | ${}^1/_2K_2A^2\cos 2\omega_a t$<br>${}^1/_2K_2B^2\cos 2\omega_b t$ |
| $2^{nd}$-Order IM Products | $K_2AB\cos(\omega_a - \omega_b)t$<br>$K_2AB\cos(\omega_a + \omega_b)t$ |
| $3^{nd}$ Harmonic Term | ${}^1/_4K_3A^3\cos 2\omega_a t$<br>${}^1/_4K_3B^3\cos 3\omega_b t$ |
| $3^{nd}$-Order IM Products | ${}^3/_4K_3A^2B\cos(2\omega_a + \omega_b)t$<br>${}^3/_4K_3AB^2\cos(2\omega_b + \omega_a)t$<br>${}^3/_4K_3A^2B\cos(2\omega_a - \omega_b)t$<br>${}^3/_4K_3AB^2\cos(2\omega_b - \omega_a)t$ |

FIG. 6

MODULATED ELECTROMAGNETIC MUSICAL SYSTEM AND ASSOCIATED METHODS

RELATED APPLICATIONS

This application is a 35 U.S.C. § 371 filing of International Application No. PCT/US2017/041403, filed Jul. 10, 2017, which claims priority to U.S. Patent Application Ser. No. 62/360,445, titled "Electromagnetic ally Augmented Musical Instrument Methods and Systems," filed Jul. 10, 2016, each of which is incorporated herein by reference in its entirety.

BACKGROUND OF THE INVENTION

Musical instruments, such as the strings, horns, brass, woodwinds, and percussion of the modern orchestra and the multitude of other non-western instruments from around the world have been known for centuries. Conventional musical instrument development has attempted to create new behaviors and new sounds, from both a purely acoustic and electroacoustic perspective. For example, modern guitars have developed significantly since the early invention of the first guitar. Similarly, the invention of the synthesized drum or drum machine provided an entirely new palette of sonic options.

In an electroacoustic musical instrument, a substantially acoustic signal is converted to an electric representation of that signal and then manipulated by electronic devices. An electro-acoustic example would be an electric guitar which has the ability to encode the acoustic vibrations of a string into an electrical signal via an electromagnetic pickup. The resultant electrical signal may then be routed through any number of electrical devices that purposely affect the electrical signal to create new sounds.

One such new sound, for example, would be the tremolo sound effect, which is now a common musical effect. The acoustic tremolo effect is a flutter-like effect that alters the frequency of the affected tone by some arbitrary modulation, which is typically produced by mechanical or electromechanical induction of a tremolo effect via acoustic amplitude frequency or phase modulation. The acoustic tremolo sound effect can be achieved by applying a mechanically induced modulation with first the Hammond Tone Cabinet (D-20) and later the Leslie Speaker (see U.S. Pat. No. 2,450,139 by Hartsough, and U.S. Pat. No. 3,014,192 by Leslie). The acoustic tremolo effect has some limitations, in that; the frequency range of the modulator is limited to low frequency oscillation below 100 Hz. Other well-known analog circuit effects can be produced through a combination of transistors, capacitors, amplifiers, inductors, and other suitable electrical and/or electronic devices.

Another example of an electro-acoustic development is a sound synthesizer or an electronic musical instrument that generates electric signals that are converted to sound through instrument amplifiers and loudspeakers or headphones. U.S. Pat. No. 4,018,121, by Chowning (hereinafter "Chowning") discloses frequency modulation (FM) for musical sound synthesis. The popularity of the sound synthesizers in popular music resulted in the development of digital modular synthesizers and digital software synthesizers, which resulted in a move away from analog electric musical instruments. In some embodiments, the input signals are generated by a computer system, based on mathematical and physical models of known acoustic systems or methods of digital signal processing (see U.S. Pat. No. 6,049,034 by Cook).

An example of an acoustic instrument electromagnetic (EM) augmentation is the control for musical instrument sustainers, or E-Bow, (see U.S. Pat. No. 6,034,316 by Hoover). This device amplifies feedback with an electromagnet to vibrate ferromagnetic strings and sustain the tones continuously.

An example of an acoustic instrument electromagnetic (EM) incorporated directly into the design of an electric instrument is the Rhodes piano (see U.S. Pat. No. 3,418,417A by Rhodes and DE2,264,786A1 by Rhodes) This device utilizes single-tine tuning forks to generate tones, which are picked up by a transducer that converts the vibrations into electrical signals, and then connected to an amplifier and a speaker and amplified Another example of an acoustic instrument that has been augmented with electronics is a magnetic resonator piano as described by McPherson & Kim [Augmenting the Acoustic Piano with Electromagnetic String Actuation and Continuous Key Position Sensing, 2010. In *NIME* (pp. 217-222)] or the Rhodes piano, which uses a single-tine fork driven by an electromagnet. Other examples include the overtone fiddle and the feedback resonance guitar (see [Advancements in actuated musical instruments. Organised Sound, 16(2), p 154-165 by Overholt, Berdahl, and Hamilton, 2011]). There currently lacks technology that allows the flexibility of modulation found on sound synthesizers on acoustic or augmented acoustic instruments. This invention bridges this gap between electronic and acoustic methods of synthesizing sound through intermodulation and frequency modulation.

An acoustic modification or augmentation of a sound reproduction system is also possible. U.S. Pat. No. 1,346,491 discloses example acoustic amplification and filtering using a waveguide or horn to increase the loudness and directionality of the sound signal.

Chowning's seminal work drew inspiration from the spurious frequency products found from frequency modulation in radio engineering. Similarly, spurious frequency products called intermodulation products typically warrants mitigation, for instance in speaker design (see U.S. Pat. No. 3,327,043A, by Martin). Recently intermodulation has been utilized in the field of Dynamic Atomic Force Microscopy (see U.S. Pat. No. 8,849,611 by Haviland et al.). Expanding frequency content rather than reducing it, rich frequency content can be produced.

BRIEF SUMMARY OF THE INVENTION

By applying a similar construction as Haviland's cantilever AFM technique and analogous physical systems, modulation products from different modulation techniques may be leveraged for the synthesis of acoustic sound.

Systems and methods produce modulation in electromagnetic (EM) musical systems. In one embodiment, a modulated EM musical system (also referred to as an augmented electromagnetic (EM) musical instrument system) is an augmented, or modified, musical instrument. In another embodiment, the modulated EM musical system is a sound reproduction system. The modulated EM musical system includes at least four key elements: (a) an acoustic carrier signal source, (b) a modulation signal source, (c) a linkage element that exhibits nonlinear behavior such as frequency mixing when driven, and (d) an acoustic output whose coupled interaction with a nonlinear interface produces nonlinear acoustic synthesis. Modulation types may include amplitude modulation, intermodulation, and frequency modulation.

Intermodulation products appear when two signals are put through a nonlinear interface, and produces high order sum-and-difference of the signal frequency's harmonics. This produces rich frequency content that may be used to synthesize sound. Similarly, manipulation of the modulated EM musical system to produce frequency modulation may also produce rich frequency content.

A harmonic oscillator is a simple signal source, where an acoustic carrier harmonic oscillator may be a physical oscillator such as a tuning fork or string actuated through the Lorentz force, such as via electromagnets.

In one embodiment, a modulated EM musical system includes a cantilever with a pointed tip and two EM actuators, such as a transducer, attached to its base. The tip of the cantilever rests lightly on a soundboard material or a drum membrane, and the height may be adjusted from the base of the cantilever. A carrier signal in audible range is driven through one of the transducers and transformed into motion at the cantilever tip. The second transducer modulates this signal by dampening the tip's motion. This is a similar technique used the field of Dynamic Amplitude Modulation AFM at a much smaller scale for microscopy.

In one embodiment, a modulated AM musical system uses an electromechanical linear actuator with a rubber, foam, or leather covered rigid member to attenuate high frequency energy in a time-varying manner without drastically changing the pitch or frequency of the tone (which occurs if the sound is fully stopped on a horn or other brass instrument). The carrier signal is produced either by human actuation (e.g. blowing) or by mechanical and/or electromechanical means, such as one or more of bellows (e.g., an organ), an actuator, and so on.

In one embodiment, an modulated AM musical system includes: an acoustic carrier harmonic oscillator; an EM actuator configured to interact with the acoustic carrier harmonic oscillator at a first frequency to produce a carrier signal having a carrier signal frequency; a dampener assembly positioned a first distance from the acoustic carrier harmonic oscillator and configured to modulate an amplitude of the carrier signal by interacting with a limited cross section of the acoustic carrier harmonic oscillator at a second frequency to generate an EM output signal associated with a produced sound. The acoustic carrier harmonic oscillator is one of a metallic string, metal bar, asymmetric tuning fork, and non-pitched percussion.

In one embodiment, the dampener excitation device is a second EM actuator. In another embodiment, the dampener excitation device is a voice coil motor having a rigid member, wherein the first distance is zero and the rigid member engages the limited cross section of the acoustic carrier harmonic oscillator.

In one embodiment, the dampener assembly further includes a damping material in contact with the acoustic carrier harmonic oscillator and made from at least one of cloth, rubber, and synthetic elastic material. In another embodiment, the EM actuator further includes a damping material in contact with the limited cross section of the acoustic carrier harmonic oscillator and made from at least one of cloth, wool, leather, foam, rubber, and synthetic elastic material. The dampener assembly may interact with the limited cross section of the acoustic carrier harmonic oscillator in one or multiple planes.

In another embodiment, the modulated EM musical system further includes a frame structure to isolate the dampening assembly the first distance from the acoustic carrier harmonic oscillator. Another embodiment the modulated EM musical system further includes a spring suspension mechanism having at least two legs and a spring, wherein the spring engages the acoustic carrier harmonic oscillator on a first end thereof and the spring suspension mechanism is situated at a second end of the acoustic carrier harmonic oscillator. The spring suspension mechanism may engage the soundboard resonator. The spring suspension mechanism may further include at least two isolation pads that engage a bottom surface on at least one of the legs. In one embodiment, the modulated EM musical system further includes an interface coupled to the EM actuator that is driven by software configured to control the first frequency.

In another embodiment, the soundboard resonator is coupled to the EM output receiver and configured to modify the received EM output signal for audio effects and amplification. In a further embodiment, the EM output receiver is coupled to an audio input module that is configured to: generate a feedback signal in response to the received EM output signal, and transmit the generated feedback signal to the audio input module, to then generate an audio input signal in response to the received feedback signal.

In another embodiment, a method modulates an acoustically generated carrier signal. An EM musical instrument has an actuator, an acoustic harmonic oscillator, and a dampening apparatus. An electromagnetic signal is applied to an acoustic carrier harmonic oscillator by means of the actuator to generate a carrier signal frequency and time varying contact is applied from the dampening apparatus to a limited cross section of the acoustic carrier harmonic oscillator to produce amplitude modulation of an acoustic sound.

In another embodiment, a modulated electromagnetic (EM) musical system includes an acoustic carrier signal source for generating an acoustic carrier signal, an EM actuator configured to generate an acoustic modulator signal, a linkage element that exhibits nonlinear behavior when mixing the acoustic carrier signal and the acoustic modulator signal, and an acoustic output coupled with the linkage element to generate acoustic modulation.

In another embodiment, a method modulates an acoustic carrier signal using a tipped-cantilever linkage element physically coupled to a source of the acoustic carrier signal. An EM actuator is controlled to impart an acoustic modulator signal to the tipped-cantilever linkage element, and a tip of the tipped-cantilever linkage element causes a nonlinear interaction with an acoustic output to modulate the acoustic carrier signal.

In another embodiment, an electromagnetic (EM) musical instrument has acoustic signal modulation and includes an harmonic oscillator for generating an acoustic carrier signal at an approximate harmonic frequency, a dampener positioned a first distance from the EM driven harmonic oscillator, an EM driven transducer for generating a modulation signal to control the dampener to modulate the acoustic carrier signal, and a linkage element coupling the EM driven transducer to the dampener to apply time varying contact of the dampener to the EM driven harmonic oscillator to modulate the acoustic carrier signal.

BRIEF DESCRIPTION OF THE DRAWINGS

FIG. 6 is a table showing example third-order transfer function expansion, in an embodiment.

DETAILED DESCRIPTION OF THE INVENTION

Signal modulation is the process of combining two signals to form a third signal containing desired properties of both signals. For example, intermodulation [amplitude modulation] is a form of signal modulation that corresponds to a multiplication in the time domain or convolution in the frequency domain of carrier and modulator signals. The modulation of these two signals produces a continuous range of sidebands that are linear combinations of harmonics present in the carrier signal. In amplitude modulation, the amplitude or "strength" of the carrier oscillations is varied. In the frequency domain, amplitude modulation produces a signal with power concentrated at the carrier signal frequency and two adjacent sidebands. Each sideband is equal in bandwidth to that of the modulating signal, and is a mirror image of the other sideband.

Embodiments described herein produce signal modulation in EM musical systems. A polynomial transfer function may describe the frequency content from modulation given an input signal $S_{in}$ and output signal $S_{out}$. For example, the transfer function may be written as:

$$S_{out} \sim K_1 S_{in} + K_2 S_{in}^2 + K_3 S_{in}^3 + K_4 S_{in}^4 \ldots = \sum_i^{\infty} K_i S_{in}^i \tag{2}$$

In the scenario of two tone intermodulation, the input signal is a sum of the acoustic carrier signal and the acoustic modulating signal. For example, two sinusoids may be given by:

$$S_{in} {}^{*} A \cos \omega_a t + B \cos \omega_b t$$

The order of intermodulation is given by how many terms the transfer function has. A third-order intermodulation would have the following output signal:

$$S_{out} \sim K_1(A \cos \omega_a t + B \cos \omega_b t) + K_2(A \cos \omega_a t + B \cos \omega_b t)^2 + K_3(A \cos \omega_a t + B \cos \omega_b t)^3$$

The expansion of this produces 12 harmonic and intermodulation products controllable through input signal strength A and B. FIG. 6 shows a table 600 illustrating example third-order transfer function expansion.

Synthesis up to 15th-order intermodulation has been observed, and coupled with frequency modulation, the output signal may be further controlled.

Figure 1B:
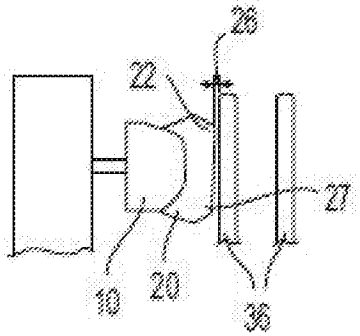
FIG. 1B is an enlarged top view of the electromagnetically augmented musical instrument system of FIG. 1A.
Figure 1A:
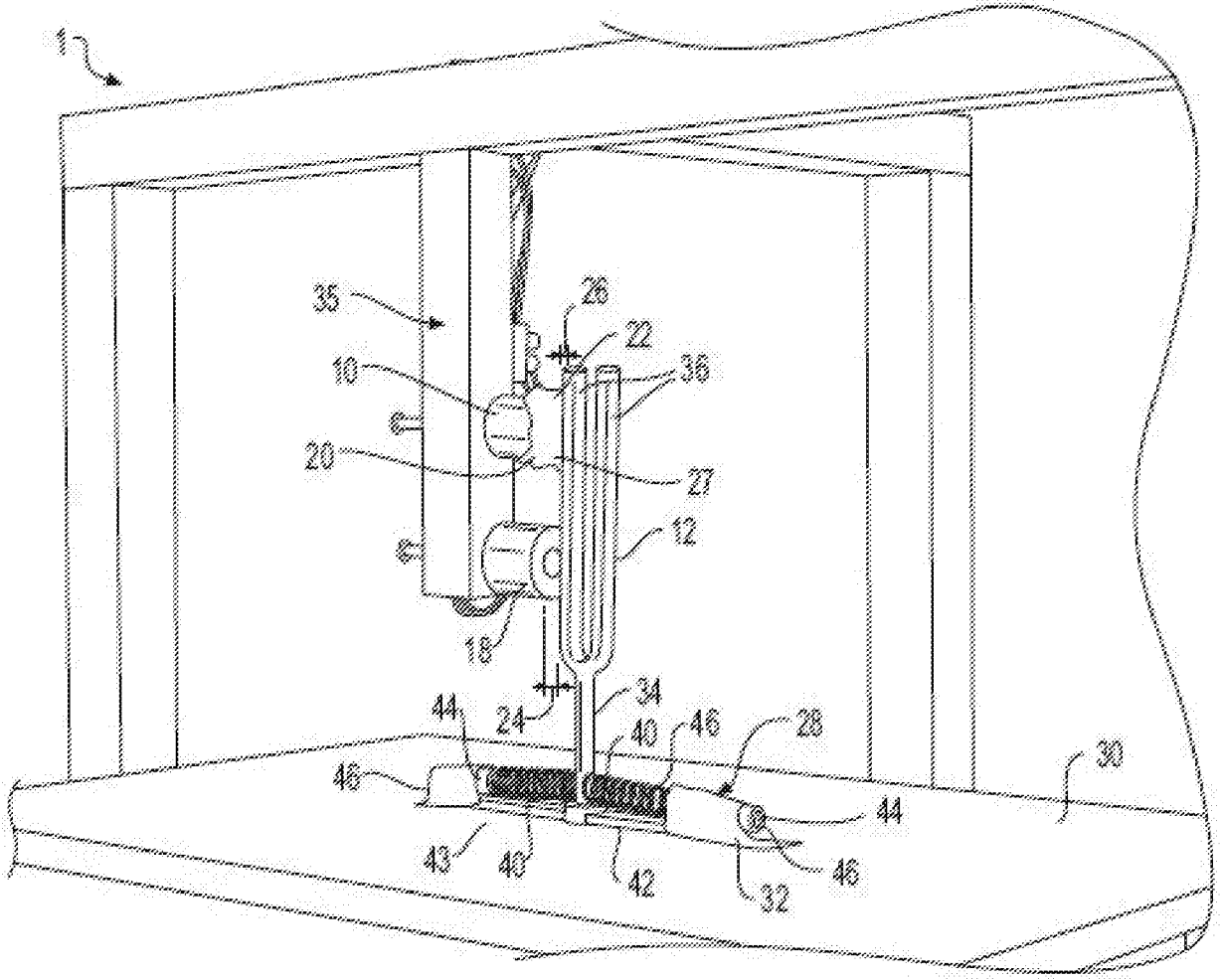
FIG. 1A is a perspective view of an electromagnetically augmented musical instrument system, in an embodiment.

FIG. 1A is a perspective view of an electromagnetically augmented musical instrument system 1, in an embodiment. FIG. 1B is an enlarged top view of the electromagnetically augmented musical instrument system 1 of FIG. 1A. FIGS. 1A and 1B may be collectively referred to as FIG. 1 herein. The system 1 includes an actuator 10, an acoustic carrier harmonic oscillator 12, a dampener 18, dampener material 20, a limited cross section of the acoustic carrier harmonic oscillator 22, a distance 24 between the dampener 18 and the acoustic carrier harmonic oscillator 12, a distance 26 between the actuator 10 and the acoustic carrier harmonic oscillator, a spring suspension subsystem 28, a soundboard or soundboard resonator 30, isolation pads 32, a structural frame 35. It is foreseen that the electromagnetically augmented musical instrument system 1 may further include amplification circuitry (not shown), as well as a transducer (not shown), such as a microphone or speaker. The soundboard 30 forms an acoustic output.

In the illustrated example of FIG. 1, the actuator 10 is a cylindrical solenoid electromagnet, which may include multiple turns of wire around a central core made of iron, steel, or other ferromagnetic material, one such example is a Magnet Sensor Systems Series E-77-82 having a pull force of 14.4 lbs. at 8.75 Watts on a 0.125 in of cold rolled steel. The actuator 10 is connected with the structure frame 35 and situated a distance 26 away from the acoustic body 12 (FIG. 1*b*).

The actuator 10 exerts a time-varying force on an acoustic body or acoustic carrier harmonic oscillator 12, such as an asymmetric tuning fork, metal bars, strings such as guitar strings, violin strings, piano strings, a snare drum, a pipe organ, a marimba bar, drum head, non-pitched percussion, etc. The acoustic carrier harmonic oscillator 12 in the illustrated example is a steel (semi ferrous) tuning fork.

In certain embodiments, where the acoustic body 12 is non-ferrous or slightly ferrous, a magnet (not shown) may be attached to acoustic carrier harmonic oscillator 12 so that the non-ferrous acoustic body 12 may be activated through the attached magnet (not shown). The actuator 10 may be offset from the magnet (not shown) rather than orthogonal to.

In certain embodiments, the actuator 10 is a Lorentz Force actuator. The size and geometric cross section may be different than what is illustrated. The actuator may be larger or smaller in dimension and may be a different geometric shape, such as rectangular, square, etc. In certain embodiments, actuator 10 may be a first actuator of a series of actuators (not shown) configured in series, parallel, or circumferential. The actuator 10 may be driven by software or hardware components or some combination thereof. The actuator 10 may be a signal corrected live input.

Figure 2:
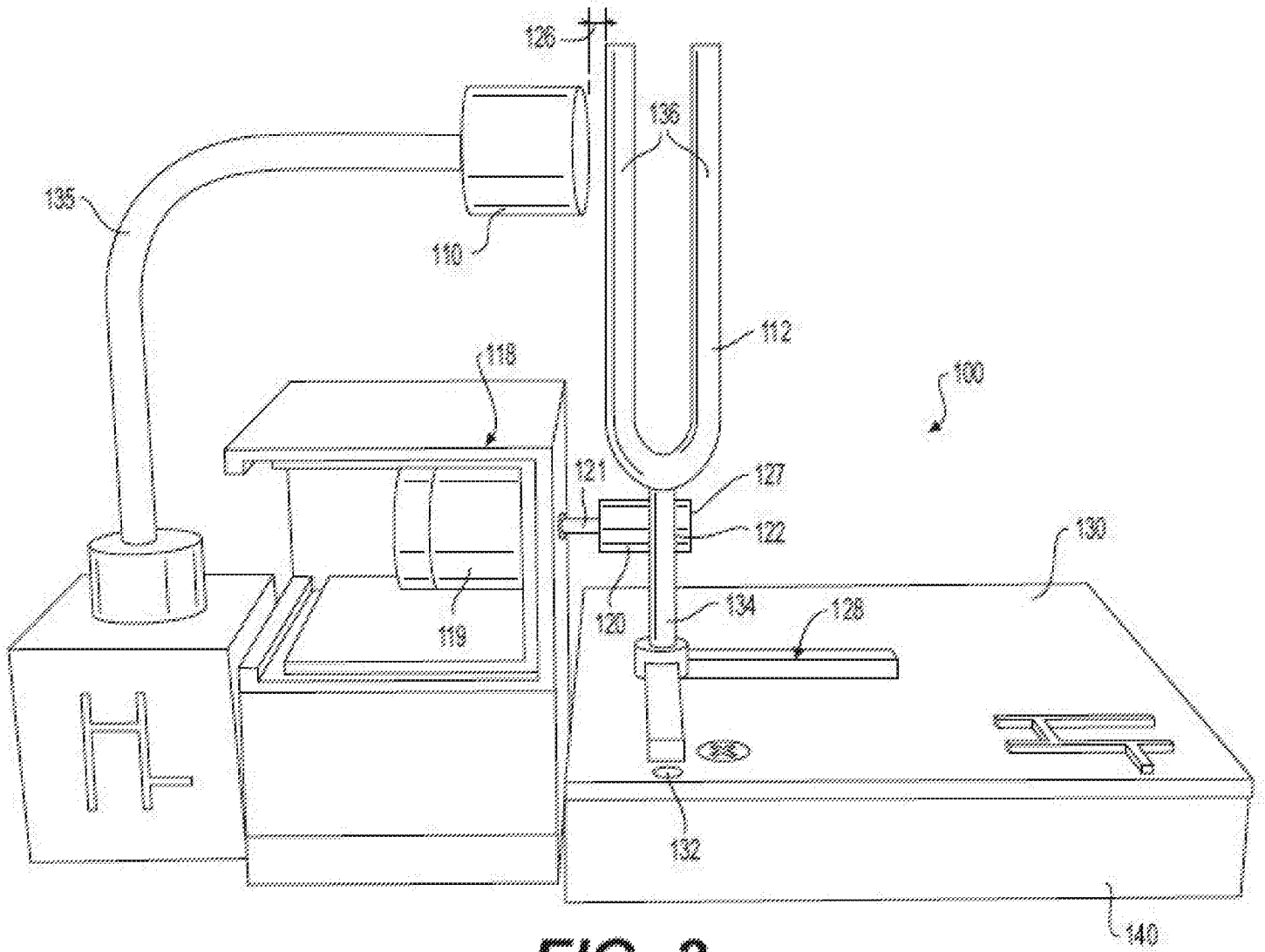
FIG. 2 is a front view of an electromagnetically augmented musical instrument system with portions of a dampening system housing removed, in an embodiment.

The actuator 10 drives the acoustic carrier harmonic oscillator 12 at a frequency, i.e. half or quarter of a natural frequency of the acoustic carrier harmonic oscillator 12, see FIG. 2 in Appendix A of U.S. Patent Application Ser. No. 62/360,445 (Appendix A provides, for disclosure purposes, a journal paper entitled "Electromagnetically Actuated Acoustic Amplitude Modulation Synthesis"). The electromagnetic force generated by the actuator 10 produces or induces vibrations in the acoustic carrier harmonic oscillator 12, thereby creating a sound output for the instrument system 1 without external audio effects and without delay, as the electromagnetic does not need a warm up delay. The actuator 10 produces an acoustic carrier signal with the symmetric tine 36 movement of the fork generating an efficient, almost perfectly sinusoidal motion in a horizontal direction (single degree of freedom) of a stem 34 or lower portion of the fork. The vibration creating an acoustic output sound. If the actuator 10 drives the tines or prongs 36 of the steel tuning fork 12 at half or one-fourth its natural frequency, this configuration produces at least one salient carrier signal at a natural frequency or some multiple of the natural frequency.

If one were to strike a tuning fork 12 or pluck string (see for example FIG. 8), its sound gradually decreases in volume with time, which is usually represented by a change damping value. This corresponds to the transient dissipation of energy after an initial force. The driving frequency of the actuator 10 is held constant to produce a consistent carrier signal at least one of the natural frequencies, as there may be more than one frequency in which resonance is reached.

To manipulate the sound output, the dampener 18 modulates the amplitude of the carrier signal of the acoustic body 12 (e.g. tuning fork 12). The modulation produces sidebands, which in turn create unique and non-linear sound outputs and effects. The dampener 18, in the illustrated embodiment of FIG. 1, is a time varying dampener (TVD), in that, it is a second EM actuator having a second driving frequency. Displacement of the fork tines 36 determines the amplitude of the periodic carrier signal, and ultimately the output sound, thus modulating the displacement of the forks prongs 36 through dampening produces an intermodulation, amplitude modulation, and/or frequency modulation of the carrier signal. The second EM actuator or dampener 18 applies force or electromagnetic pull to the fixed stem 34 and causes acoustic body 12 to pivot slightly. When the acoustic body 12 pivots, the actuator 10 is no longer at the distance 26 away from a prong 36, i.e., 2 mm, and the acoustic body 12 makes contact with the actuator 10 at a small cross section 22 of the prong 36. The angle of adjustment (not shown) is small and contact area 22 is small, but contact between the tuning fork tine 12 and the actuator 10 produces the amplitude modulating TVD effect. The effect corresponds to a non-sinusoidal, periodic modulation signal that is controlled by the frequency or pulse length of the dampener 18. Since the constant drive frequency from the carrier electromagnet actuator 10 continues to excite the tines 36, the natural frequency of the tuning fork 12 remains the same even through the small contact with the actuator 10.

The dampening effect alters the loudness of the sound to produce harmonics called sidebands, which are a byproduct of attenuation of the amplitude (or loudness) of the carrier signals. The dampening effect creates an altered sound output or timbre of the augmented musical instrument system 1. The dampening system 18 allows for a tremolo effect at higher frequencies, i.e. above 100 Hz. It is foreseen that the dampening frequency my further include delays, stops, or timed pulses. It is also foreseen that the dampener 18 may include more than one dampener either along one plane or multiple planes about the acoustic body 12. The actuator 10 and dampening system 18 are illustrated along one plane and thereby affect one single degree of freedom with respect to the tuning fork 12, but it is foreseen that several actuators (not shown) may generate complex timbre using multiple locations across several degrees of freedom.

In the illustrated example, a dampening material 22 covers or substantially covers an end 27 of the actuator 10. The dampening material 22 is purposed to interact with the contact area 22. The actuator 10 still maintains a distance 26 away from the prong 36 of the tuning fork 12 with the dampening material 38 covering the end 27. The dampening material 22 may be made of cloth, wool, foam, leather, synthetic plastic, rubber, and may further include adhesive material (not shown).

A spring suspension system 28 includes at least one spring 40 and a base or amplifier interface 42, and steel end blocks 44. The base 42 has at least two legs 43 or is T-shaped. The spring suspension system 28 further includes an aperture or hole (not shown) for which the acoustic body 12 is situated within. In the illustrated embodiment, the springs 40 engage the stem 34 of the tuning fork 12 and are attached at opposed ends 46 to the steel end blocks 44. Two end-blocks 44 control the tension of the springs 40 to restore or force the stem 34 to return to the mass's equilibrium position. In the illustrated example, the equilibrium position is upright or vertical.

The sound output is transferred from the prongs 36 of the tuning fork to the stem 34 and finally to the acoustic soundboard 30. The base 42 acoustically transduces the output sound from the stem 34 into the soundboard or acoustic amplifier 30. The illustrated T-frame base 42 is designed to separate the structure holding the electromagnetic actuators 10, 18 from the tuning fork 12 and act as a stabilization mechanism 28. The T-frame base 42 and springs 40 may be made from plastic, metal, or metal alloys.

The loss or decreased signal bleed caused by vibration and other noise generated by the EM actuators 10, 18. Additional non-active components may decouple the force generating noise from the desired output signals and acoustically amplify the signals. Sound isolation pads 32 further reduce propagation of noise through the suspension system 28. To amplify the desired signals, a thin soundboard or acoustic resonator 30 consistent with surfaces commonly used to amplify tuning forks 12 is connected with the suspension system 28. A soft foam structure (not shown) is foreseen to be located below the soundboard 30.

A second embodiment is shown in FIG. 2, therein illustrated an electromagnetically augmented musical instrument system 100 in accordance with the present invention. The system 100 includes an actuator 110, an acoustic carrier harmonic oscillator 112, a dampening system 118, dampener material 120, a limited cross section of the acoustic carrier harmonic oscillator 122, a distance (not shown) between the dampener 18 and the acoustic carrier harmonic oscillator 112, a distance 126 between the actuator 10 and the acoustic carrier harmonic oscillator, an amplifier interface 128, a soundboard or amplifier resonator 130, isolation pads 132, and a structural frame 135. It is foreseen that the electromagnetically augmented musical instrument system 100 may further include amplification circuitry (not shown), as well as a transducer (not shown), such as a microphone or speaker.

In the illustrated example of FIG. 2, the actuator 110 is substantially similar to the actuator 10. The actuator 110 is connected with a flexible structural frame 135. The actuator 110 is positioned a distance 126 away from the acoustic body 112. The acoustic carrier harmonic oscillator 112 in the illustrated example is a steel (semi ferrous) tuning fork and is substantially similar to the acoustic body 12.

The dampener assembly 118 in the illustrated embodiment is a time varying dampener (TVD), in that, the dampening system 118 includes an electric motor 119, such as a linear DC motor, voice coil motors (VCM) or voice coil actuators (VCA). The motor 119 having a second driving frequency, i.e. between 0.01 Hz to 15 kHz in which it may operate. The peak performance of the augment instrument 100 is when the dampener assembly 118 is driven between twice the carrier signal frequency minus 200 Hz. The motor 119 uses a stationary coil (not shown) to vibrate a magnetized piece of metal, iron, reed, rigid membrane, or armature 121. The armature 121 is positioned in a plane orthogonal to a plane in which the actuator 110 is situated.

Displacement of the fork tines 136 determines the amplitude of the periodic carrier signal, and ultimately the output sound, thus modulating the displacement of the forks prongs 136 through dampening from the dampening system 118 produces an intermodulation, amplitude modulation, and/or frequency modulation of the carrier signal of the tuning fork 112. The motor 118 vibrates the rigid membrane 121, such that, the rigid membrane 121 makes contact with at least one of the fork prong 136 or to the fixed stem 134 and thereby, causing modulation of the amplitude of the carrier signal of the acoustic body 112.

It is envisioned that the distance 124 from the rigid membrane 121 from the acoustic body 12 is a distance, but for practical reasons that distance may approximate zero. The vibration of the armature 121 and contact area 122 may be small, but this small contact between the tuning fork tine 136 and the armature 121 produces the amplitude modulator actuated TVD effect. The effect corresponds to a non-sinusoidal, periodic modulation signal that is controlled by the frequency or pulse length of the dampener motor 119. Since the constant drive frequency from the carrier electromagnet actuator 110 continues to excite the tines 136, the natural frequency of the tuning fork 112 remains the same even with the small contact from the armature 121. This is not true for augmented non-actuated acoustic musical instruments, as will be further discussed below.

The dampening alters the loudness of the sound to produce sidebands with each contact creating an altered sound output or timbre. The dampening system 118 allows for a tremolo affect at higher frequencies. It is foreseen that the dampening frequency my further include delays, stops, or timed pulses. It is also foreseen that the dampener 118 may include more than one dampener either along one plane or multiple planes.

In the illustrated example, the dampening system 118 includes a dampening material 122 covering or substantially covering an end 127 of the armature 121. The dampening material 122 is purposed to interact with the contact area 122 of the acoustic body 12, shown in FIG. 2 at the stem 134. The dampening material 122 may be made of cloth, wool, foam, synthetic plastic, rubber, and may further include adhesive material (not shown).

The amplification interface 128 includes a base 142 has at least two legs 143 or is T-shaped, as illustrated. The amplifier interface 28 further includes an aperture or hole (not shown) for which the acoustic body 112 is situated within. The illustrated T-Frame base 42 is designed to separate the structure 135 holding the electromagnetic actuators 110 from the tuning fork 112 and soundboard 130. The T-frame may be made from plastic, metal, or metal alloys or combination thereof.

The sound output is transferred from the prongs 136 of the tuning fork to the stem 134 then to the base 142 which is connected to an acoustic soundboard 130. The base 142 acoustically transduces the output sound from the stem 34 into the soundboard or acoustic amplifier 130. The acoustic soundboard 130 is substantially similar to the soundboard 30, as explained above.

Sound isolation pads 132 further reduce propagation of noise through the interface 28. The sound isolation pads 132 are located on a bottom surface (not shown) of the interface base 142. A soft foam structure 140 is located below the soundboard 130.

Figure 3:
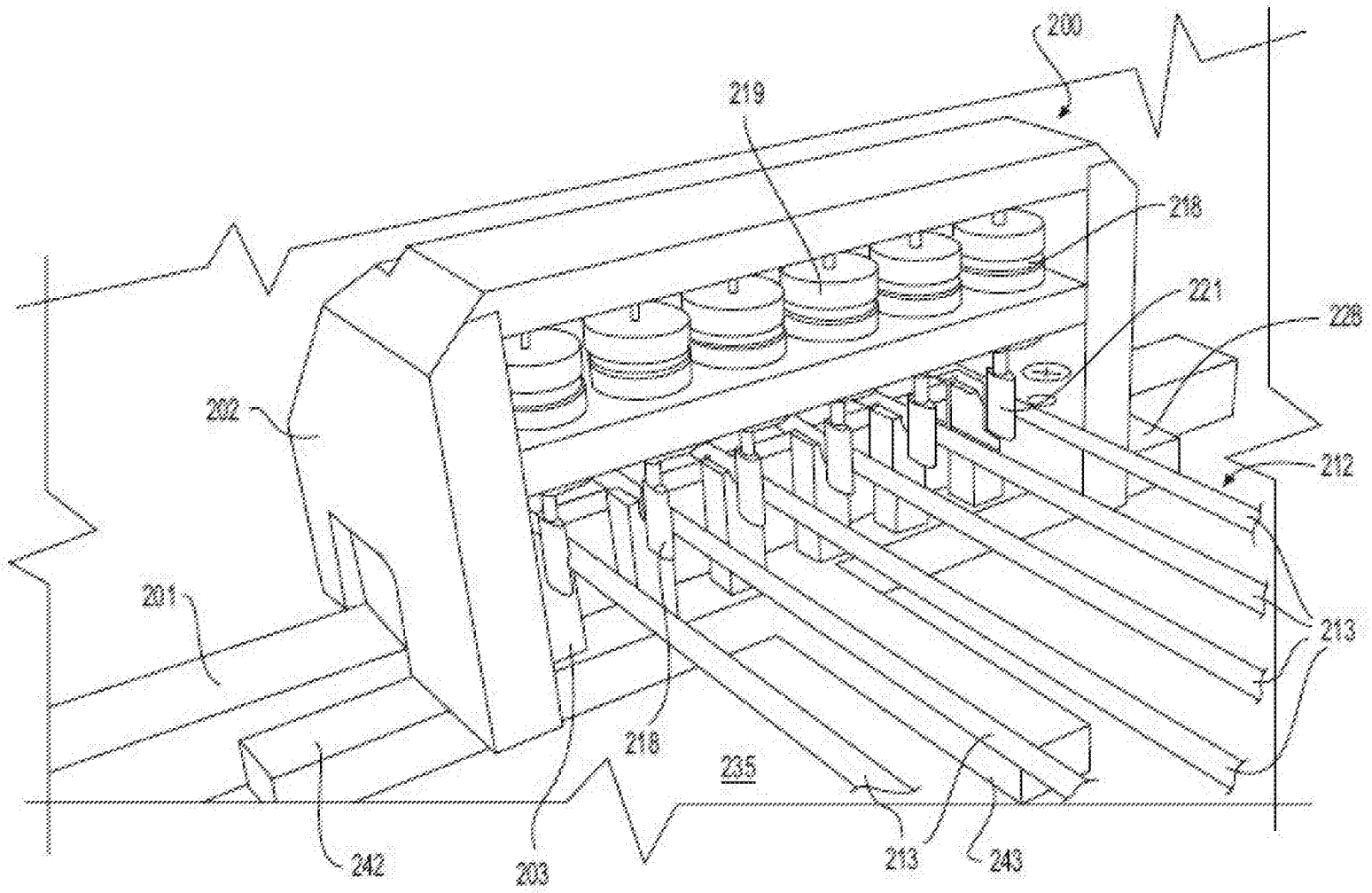
FIG. 3 is a top perspective view of an electromagnetically augmented musical instrument system, in an embodiment.

A third embodiment of the present invention is shown in FIG. 3, therein illustrated an electromagnetically augmented musical instrument system 200 in accordance with the present invention. The system 200 includes an instrument bridge 201, a series of acoustic carrier harmonic oscillators 212, a dampening subassembly 218, a spring suspension system 228, and an instrument body 235. It is foreseen that the electromagnetically augmented musical instrument system 200 may further include amplification circuitry (not shown), as well as a transducer (not shown), such as a microphone, sensor, or speaker.

In the illustrated example of FIG. 3, the series of acoustic carrier harmonic oscillators 212 are illustrated as six individual strings 213 terminated at the bridge 201, each string 213 is actuated at its natural frequency by a user to generate force by bowing, plucking, striking, rubbing, or blowing and is not electromagnetically activated. It is foreseen that the musical instrument system could include more or less individual strings 213.

The dampener assembly 118 in the illustrated embodiment, is series of time varying dampeners (TVD), in that, it is a series of electric motors 219, such as a linear DC motor, voice coil motors (VCM) or voice coil actuators (VCA) each having a driving frequency within standard operating ranges, which include the audible frequency range. Each motor 219 being capable of being driving at the same frequency at the same time or different. Each of the motors 219 is housed in a sound isolating bridge structure or housing 202 that is situated above the bridge 201. Each of the motors 219 use a stationary coil (not shown) to vibrate a magnetized piece of metal, iron, reed, rigid membrane, or armature 221. Each of the armatures 221 are positioned in a plane orthogonal to a plane in which the strings 213 are activated.

Displacement of at least one string 213 determines the amplitude of the periodic carrier signal, and ultimately the output sound, thus modulating the displacement of the string 213 through damping from the dampening system 218 produces an intermodulation, amplitude modulation, and/or frequency modulation for each string that is activated or user dependent, meaning it is foreseen that at least one dampener motor 219 may not become activated when the string 213 is actuated. It is envisioned that at least one of the motors 218 vibrate the respective rigid membrane 221, such that, the rigid member 221 makes contact with the respective string 213 and causes modulation of the amplitude of the carrier signal of the strings 213.

It is envisioned that the distance from the rigid membrane 221 from the respective strings 213 is an equal distance 224, which may approximate zero. It is foreseen that at least one motor 219, the distance 224 could be different than the others in the series 218. The vibration of the armature 221 causes the armature 221 to make contact with a small contact area 222 on the string, which in turn produces the amplitude modulator actuated TVD effect. This corresponds to a non-sinusoidal, periodic modulation signal that is controlled by the drive frequency or pulse length of the dampener motor 219. As discussed above, it is foreseen that at least one motor 219 in the series of dampeners 218 may be off.

The dampening effect of each motor 219 alters the sound and the sidebands of the carrier signal to create an altered sound output or timbre for each individual string 213. The dampening system 218 allows for a tremolo effect at higher frequencies. It is foreseen that the dampening frequency my further include delays, stops, or timed pulses. It is also foreseen that the dampener 218 may include more than one dampener per string 213 either along one plane, multiple planes, or circumferential.

In the illustrated example, the dampening system 218 includes a dampening material 222 covering or substantially covering an end 127 of each of the armatures 221. The dampening material 222 is purposed to interact with a small contact area 222 of the string 213. The dampening material 222 may be made of cloth, wool, foam, synthetic plastic, rubber, and may further include adhesive material (not shown).

An amplifier interface 228 includes a base 242, which has at least two legs 243 or is T-shaped, as illustrated. The amplifier interface 228 is located below a series of saddles 203 that hold the strings 213 at a height above the instrument frame or wooden soundboard 235. The vibrating wooden soundboard 235 creates a richer tone than vibrating stings alone. The vibrating wooden soundboard 235 forms an acoustic output. A vibrating acoustic soundboard 235 is typically louder than the strings 213 alone. The characteristic sound of an acoustic stringed instrument is predominantly created by the amplification made by the soundboard 235, not the strings 213 themselves. The amplifier interface 228 further includes an aperture or hole (not shown) for which at least one string 213 is situated within. The T-frame may be made from plastic, metal, or metal alloys or some combination thereof. It is foreseen that sound isolation pads (not shown) may be situated below the base 242 to further reduce propagation of noise through the suspension system 228.

It is foreseen that the musical instrument system 1, 100, 200 may further include a microphone, such as Earthworks QTC50 omnidirectional microphone or a Shure SM58 situated a distance from the soundboard, i.e. 20 mm. It is foreseen that musical instrument systems 1, 100, 200 may further include amplification effects once sampled through the microphone. It is foreseen that the electromagnetically augmented musical instrument systems 1, 100, 200 may create a self-feedback using a pickup, sonic transducer, or via acoustic feedback to modify the signal through a subtractive or additive synthesis. It is foreseen that the present invention could further include sensors, such as Piezo sensors to sense vibrations of the acoustic body 12.

Figure 4:
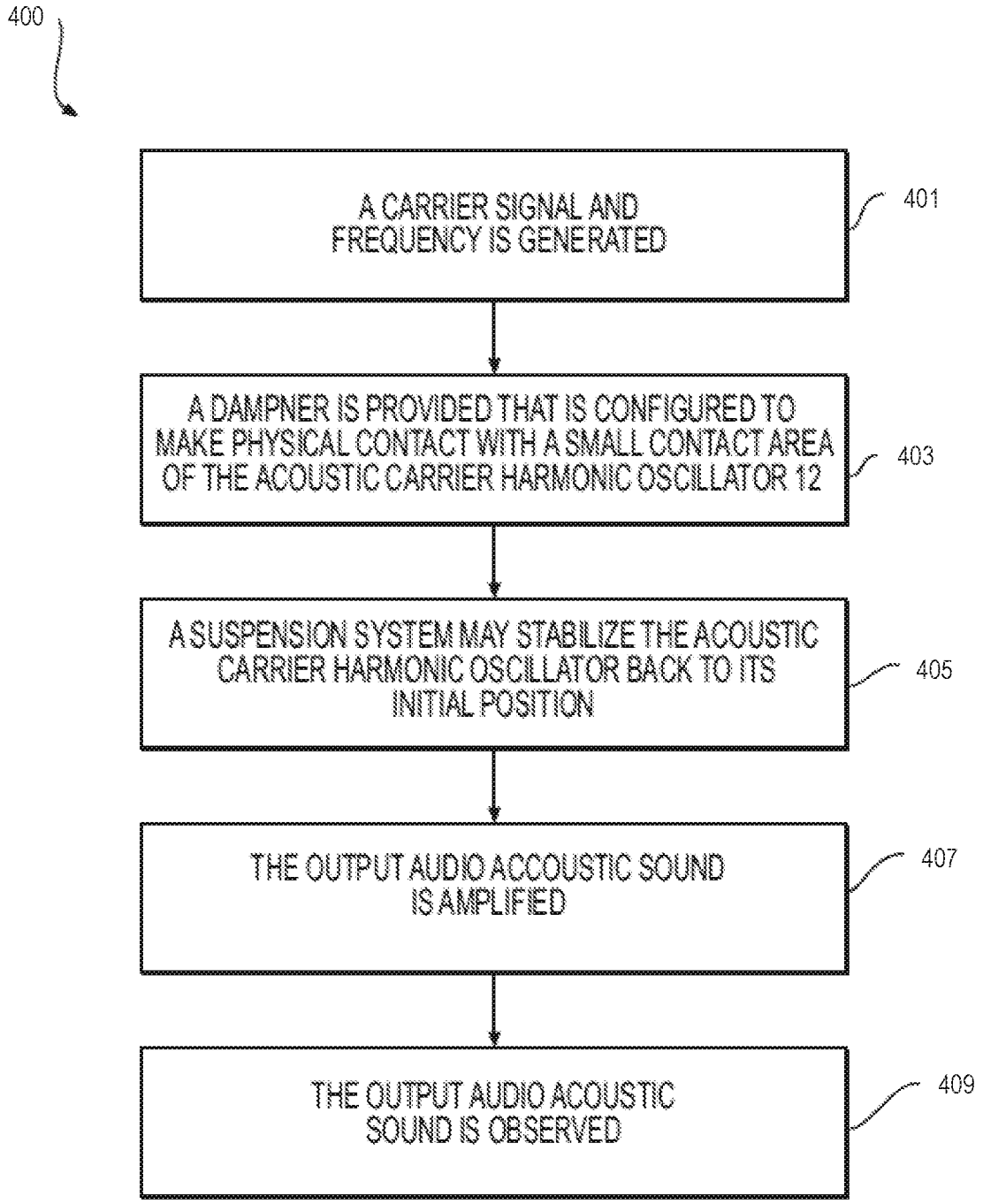
FIG. 4 is a flowchart illustrating one example method of intermodulation, amplitude modulation, and/or frequency modulation of an electromagnetically augmented musical instrument, in an embodiment.

FIG. 4 is a flowchart illustrating one example method 400 of intermodulation, amplitude modulation, and/or frequency modulation of an electromagnetically augmented musical instrument.

At block 401, a carrier signal and frequency is generated. This block may be performed by an actuator, for example the actuator 10 of FIG. 1, or by physical force generated by bowing, plucking, striking, rubbing, or blowing, or manipulation of an acoustic carrier harmonic oscillator, such as the acoustic body 12 of FIG. 1. The carrier signal being a sound.

At block 403, a dampener is provided that is configured to make physical contact with a small contact area 22 of the acoustic carrier harmonic oscillator 12. This block may be performed by a second actuator, for example the dampener 18 of FIG. 1 or the dampener 118 of FIG. 2 as described above. The dampener manipulates the carrier signal amplitude or strength through modulation, thereby outputting a manipulated audio acoustic sound. This block may include dampener frequency adjusts with delay components or pulses.

At block 405, a suspension system may stabilize the acoustic carrier harmonic oscillator back to its initial position, thereby returning the carrier signal back to the original amplitude. At this block, if there are no springs, then the suspension system may also act as an amplifier interface that connects the acoustic body 12 to the soundboard 30.

At block 407, the output audio acoustic sound is amplified. This block may be performed a soundboard, for example the soundboard 30 of FIG. 1.

At block 409, the output audio acoustic sound is observed. This may also be observed by electronics such as a transducer, sensors, amplifier, or receiver.

Figure 5:
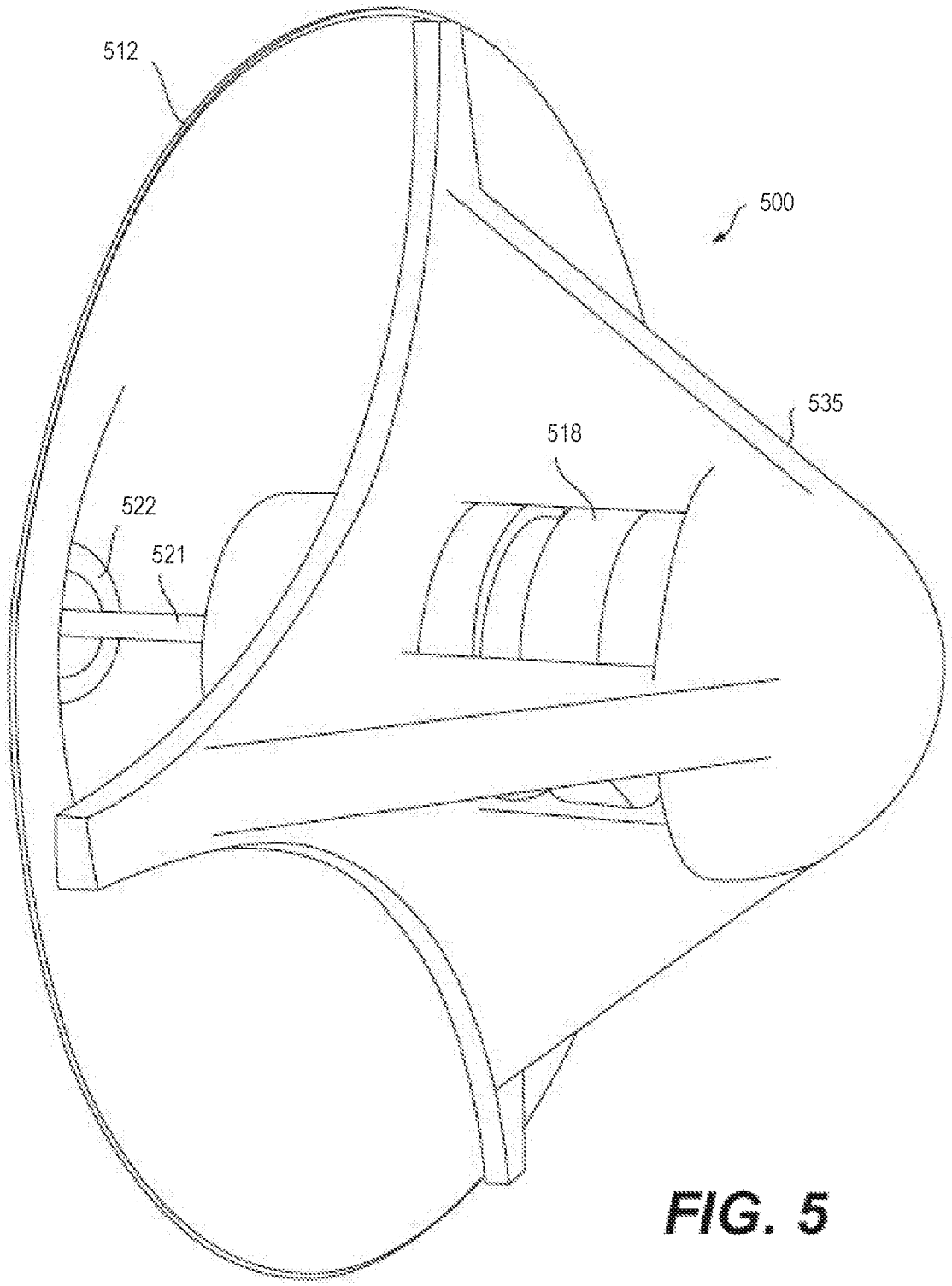
FIG. 5 is a perspective view of an electromagnetically augmented musical instrument system, in an embodiment.

FIG. 5 is a perspective view of an electromagnetically augmented musical instrument system 500, wherein a wind, brass, and organ instrument may be altered. The system 500 includes an, an acoustic carrier harmonic oscillator 512, a dampener assembly 518, dampener material 520, a limited cross section of the acoustic carrier harmonic oscillator 522, a distance 524 between the dampener assembly 518 and the acoustic carrier harmonic oscillator 522, a structural frame 535. In certain embodiment, the electromagnetically augmented musical instrument system 500 may further include amplification circuitry (not shown), as well as a transducer (not shown), such as a microphone or speaker.

The dampener assembly 518 may be a baffle or membrane set across the opening of a wind instrument and actuated by the EM Actuator. The combination of the membrane and fluid around it acts as the linkage element. The physical medium is air, although propagation in any fluid medium is possible, such as water or other liquids.

Figure 7:
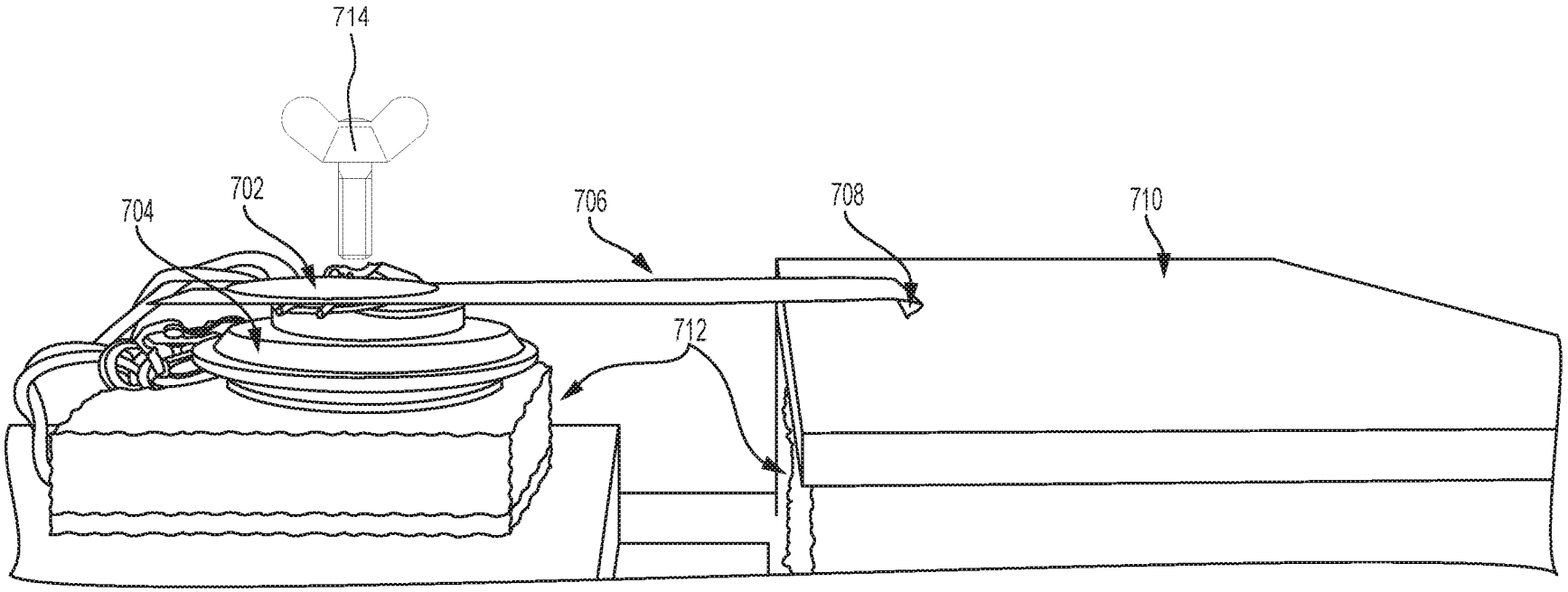
FIG. 7 is a perspective view of one example cantilever based modulated EM musical system, in an embodiment.

FIG. 7 is a perspective view of one example cantilever based modulated EM musical system 700. Modulated EM musical system 700 uses a cantilever 706 with a pointed tip 708 as the linkage element, an acoustic carrier transducer 702 and a modulation transducer 704. The pointed tip 708 of the cantilever 706 rests lightly on a soundboard 710. The height of the cantilever 706 and tip 708 may be adjusted from the base of the cantilever. The nonlinear interaction between the tip 708 and the soundboard 710 produces the intermodulation as described above for system 1. In the example of FIG. 7, acoustic carrier transducer 702 is a piezoelectric transducer that forms a carrier signal source that is injected into the cantilever 706. The modulation transducer 704 is a voice coil that provide an EM modulator signal that is applied to the acoustic carrier transducer 702.

The cantilever 706 is formed as a thin rectangular copper metal that is affixed to the modulation transducer 704. The motion imparted to the cantilever 706 by the acoustic carrier transducer 702 and the modulation transducer 704 is transferred to the cantilever tip 708 and produces sideband frequency components on the soundboard 710 to form an output signal (e.g., a sound). The nonlinear interaction between the tip 708 and the soundboard 710 generates additional frequency components. The cantilever design produces amplified motion at the tip 708 as compared to motion of the actuators 702 and 704. The soundboard 710 is a physical medium that amplifies the output signal to produce the sound. The soundboard 710 thereby forms an acoustic output. A foam 712 may be used for sound isolation to mitigate transduction of vibration between the system 700 and a platform the system is placed upon.

Figure 10:
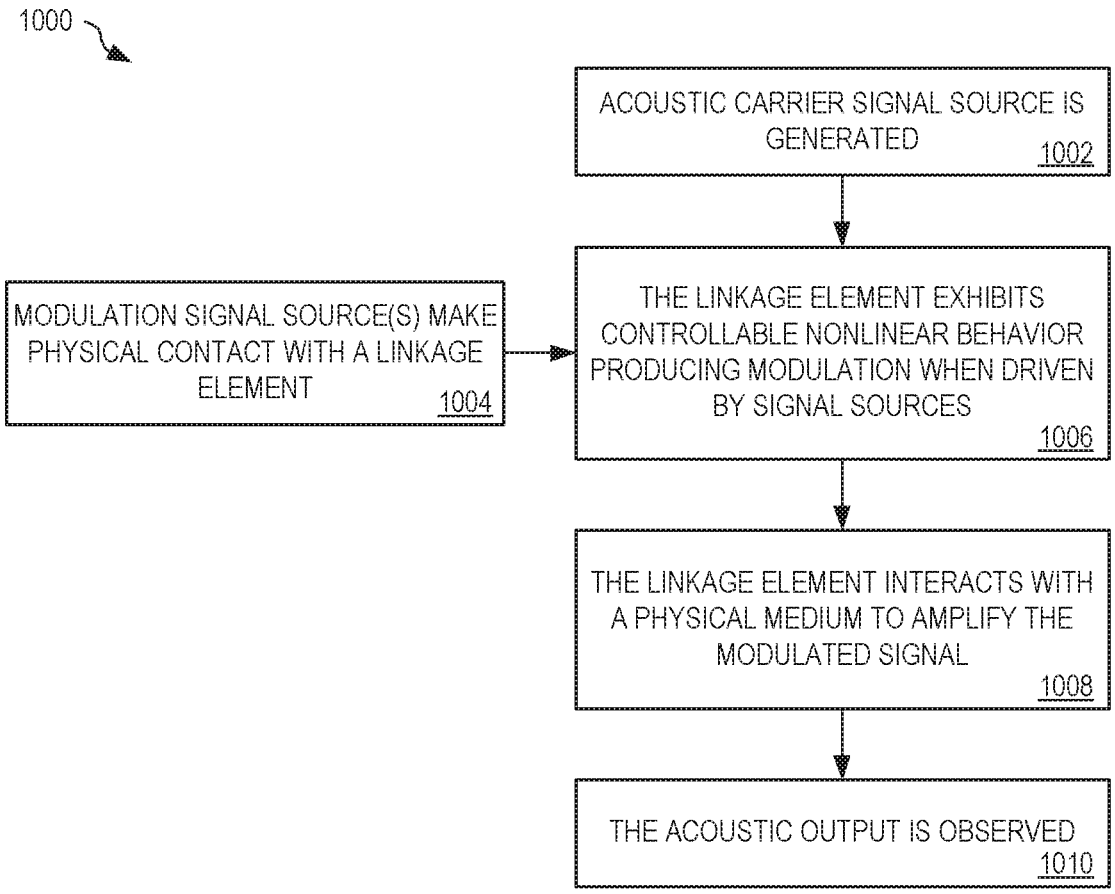
FIG. 10 is a flowchart illustrating one example method of intermodulation, amplitude modulation, and/or frequency modulation of a modulated EM musical system, in an embodiment.

The cantilever 706 may also be referred to as a linkage element, as described in block 1006 of FIG. 10. The modulation transducer 704 is attached beneath the non-tipped end of the cantilever 706, acting as the acoustic carrier signal source as described in block 1002. When a signal is injected through the modulation transducer 704, the cantilever tip 708 oscillates. When driven at a resonant frequency of the cantilever 706, the oscillation is at maximum. The audible range is sufficiently near the resonance frequency of the cantilever.

The acoustic carrier transducer 702 (e.g., a Piezo-transducer) injects the modulation signal source as described in block 1004. This dampens or exacerbates the motion of the cantilever tip 708, producing nonlinear motion.

The cantilever tip 708 gently rests on the surface of the soundboard 710. How "gently" may be adjusted by the relative heights of the foam 712, or, in certain embodiments, may be adjusted with a mechanical screw 714. The cantilever tip 708, when in motion, produces a tip-surface nonlinearity that produces additional frequency components known as intermodulation products. The intermodulation products' frequency components take the form of:

$$k_a\omega_a \pm k_b\omega_b \text{ for } k_a+k_b \leq N.$$

Where $\omega_a$ and $\omega_b$ are the carrier and modulating frequencies, $k_a$ and $k_b$ are integers, and N is the order of Intermodulation. The weight of these frequency components depend on the material of soundboard 710 and the injected strengths of the carrier and modulator signals.

The use of transducers allows direct variation over both the carrier and modulator frequencies and amplitude. Based on variation of material and signal injection, intermodulation is on the order of $10^1$. Frequency modulation may be applied through the injected signal or through a similar process of FM AFM. Not only is this an effective way of modulation, the cantilever 706 has direct application to embodiments of FIGS. 1, 2, 8, and 9.

Figure 8:
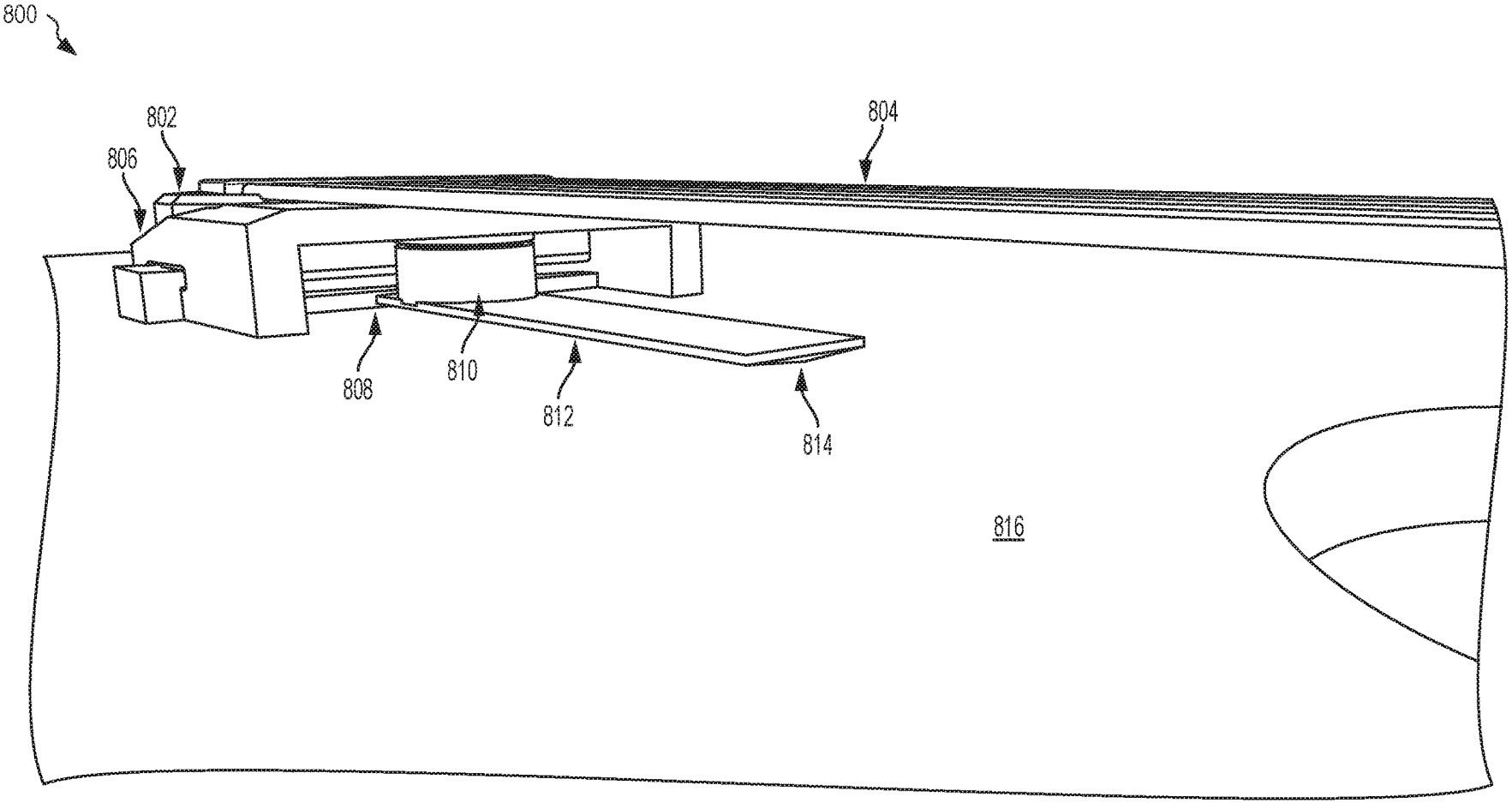
FIG. 8 is a perspective view of one example string based modulated EM musical system, in an embodiment.

FIG. 8 is a perspective view of one example string based modulated EM musical system 800, in an embodiment. The modulated EM musical system 800 includes an instrument bridge 802 of a string instrument (illustratively shown as part of an acoustic guitar), a carrier signal source 804 consisting of plucked or EM sustained strings, a sound isolating bridge structure housing 806 (similar to sound isolating bridge structure or housing 202 of FIG. 3). The system 800 also includes an EM modulation source 810 that is for example an EM actuator, a cantilever 812, similar to cantilever 706 of FIG. 7, that is supported by a cantilever bridge 808 that transfers energy from the carrier signal source 804 to the cantilever 812. The cantilever 812 thereby mixes transduced signals from the cantilever bridge 808 and EM modulation source 810 to generate vibration and/or motion at a cantilever tip 814 (e.g., similar to cantilever tip 708 of FIG. 7) where a tip-surface nonlinearity between tip 814 and a soundboard 816 produces additional frequency components within the output signal. The soundboard 816 is a surface of an acoustic guitar or other string instrument, for example. The soundboard 816 thereby forms an acoustic output.

The string based modulated EM musical system 800 is analogous to the cantilever based modulated EM musical system 700 of FIG. 7 with the following key difference in components. The linkage elements (e.g., as referenced in block 1006 of FIG. 10) of the string based modulated EM musical system 800 are formed of a combination of the instrument bridge 802, the sound isolating bridge structure housing 806, and the cantilever 812. Note the form of the sound isolating bridge structure housing 806 depends on the instrument, depicted in FIG. 8 as an acoustic guitar. The acoustic carrier signal source 804 (as referenced in block 1002) is a plucked, EM sustained, or bow sustained string. The modulator signal source (as reference in block 1004) is the EM modulation source 810, which takes an injected signal from an external source or feedback source from a pick-up. With these analogous components, intermodulation as described for FIG. 7 description is similarly achieved for a stringed musical instrument.

Figure 9:
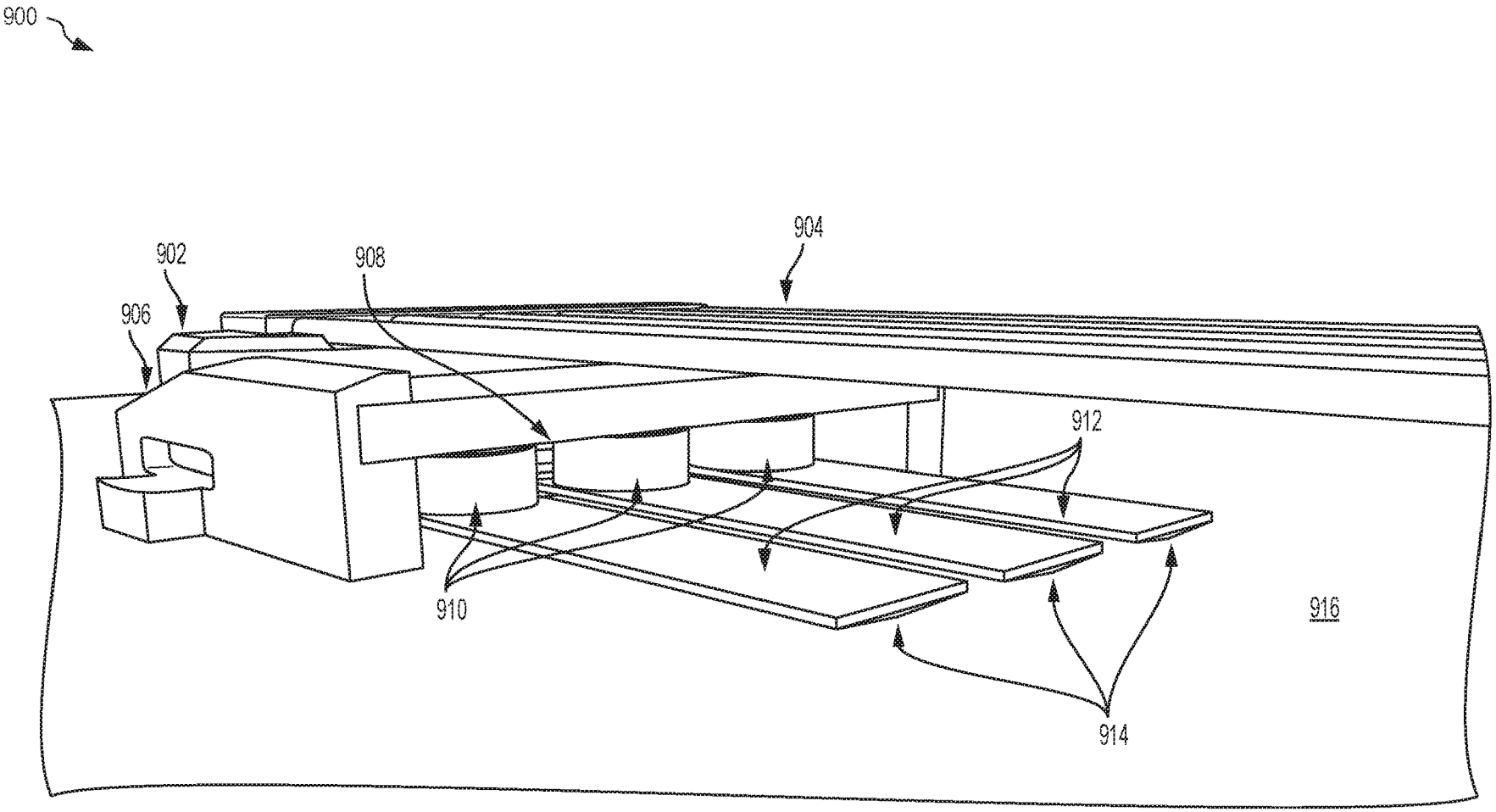
FIG. 9 is a perspective view of one example multiple string based modulated EM musical system, in an embodiment.

FIG. 9 is a perspective view of one example multiple string based modulated EM musical system 900, in an embodiment. The modulated EM musical system 900 includes an instrument bridge 902 of an acoustic guitar or other string instrument, a carrier signal source 904 consisting of plucked or EM sustained strings, a sound isolating bridge structure housing 906 (similar to sound isolating bridge structure housing 806 of FIG. 8), a cantilever bridge 908 that supports a plurality of cantilevers 912 and transfers energy from the carrier signal source 904 to the cantilevers 912. The modulated EM musical system 900 also includes a plurality of EM modulation sources 910, each consisting of at least one EM actuators. The number of EM modulation sources 910 and/or EM actuators may be arbitrary and selected depending on the context or design of the modulated EM musical system 900. Each cantilever 912 is similar to cantilever 812 of FIG. 8 and functions to mix the transduced signals from the cantilever bridge 908 and a respective one of the EM modulation sources 910, resulting in vibration and/or motion at a cantilever tip 914 of the cantilever 910. There may be an arbitrary number of cantilevers 912 depending on the context or design of the modulated EM musical system 900. Each cantilever tip 914 is similar to the cantilever tip 814 of FIG. 8 and functions to mix transduced signals from the cantilever bridge 908 and respective EM modulation source 910 to generate vibration and/or motion at the respective cantilever tip 914 where a tip-surface nonlinearity between tip 914 and a soundboard 916 produces additional frequency components within the output signal. The soundboard 916 is a surface of an acoustic guitar or other string instrument, for example. The soundboard 916 thereby forms an acoustic output.

Where FIG. 8 depicts all signal sources injected through a single bridge and cantilever linkage element (e.g., six strings to one linkage element), FIG. 9 depicts a configuration with two strings to one linkage element. That is, two strings form the acoustic carrier signal source (as referenced in block 1002) for each cantilever 912. The number of cantilevers 912 may be increased based on the desired ratio of signal sources (e.g., the number of carrier signal sources divided by the number of modulation signal sources).

FIG. 10 is a flowchart illustrating one example method 1000 of intermodulation, amplitude modulation, and/or frequency modulation of a modulated EM musical system, in an embodiment. Method 1000 is for example a generalized acoustic modulation synthesis method that may be implemented by any one of electromagnetically augmented musical instrument systems 1, 100, and 500 of FIGS. 1, 2 and 5, and modulated EM musical systems 700, 800 and 900 of FIGS. 7, 8 and 9, respectively.

At block 1002, an acoustic carrier signal is generated. In one example of block 1002, a string of the modulated EM musical system 800 of FIG. 8 is plucked. At block 1004, a modulation signal source(s) makes physical contact with a linkage element. In one example of block 1004, the EM modulation source 810 imparts a vibration to the cantilever 812. In block 1006, the linkage element exhibits controllable nonlinear behavior producing a modulation when driven by the signal sources. In one example of block 1006, the cantilever tip 814 of the cantilever 812 exhibits controllable nonlinear behavior when driven by the cantilever bridge 808 and EM modulation source 810. In block 1008, the linkage element interacts with a physical medium to amplify the modulated signal. In one example of block 1008, the tip-surface nonlinearity between tip 814 and the soundboard 816 amplifies the modulated signal and produces sound. In block 1010, the acoustic output is observed. In one example of block 1010, a listener hears the sound generated by the soundboard 816.

Figure 11:
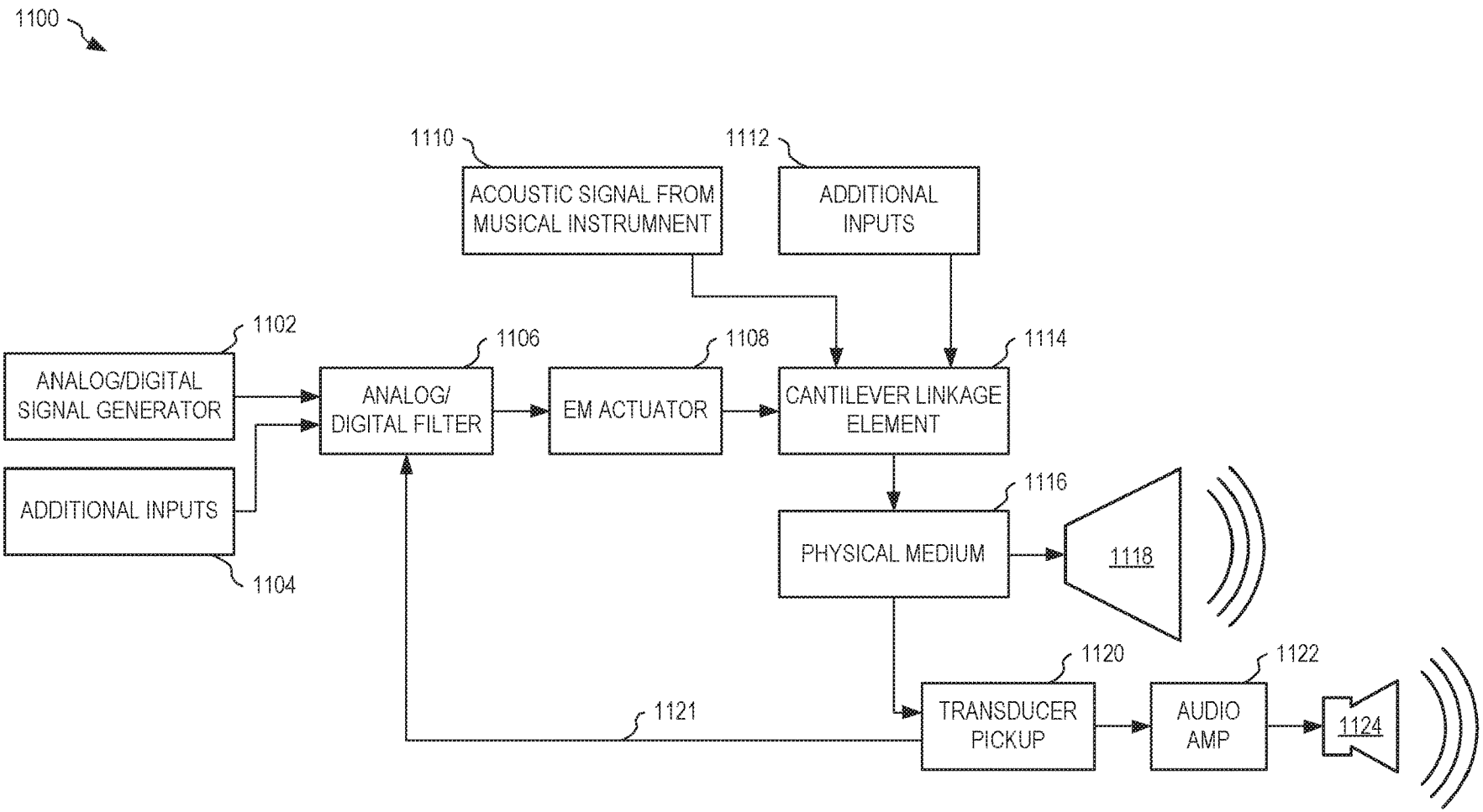
FIG. 11 is a functional block diagram illustrating one example cantilever based modulated EM musical system, in an embodiment.

FIG. 11 is a block diagram illustrating one example cantilever based modulated EM musical system 1100. A signal source may be acoustic or may be generated electromagnetically in many ways. For example, the systems 700 and 800, shown in FIGS. 7 and 8, respectively, may use different types of inputs. The electric inputs may be a signal produced from inserting an 8 mm audio jack, or wired directly, and this signal may be produced from an analog or digital synthesizer, playback from an audio recording, from a live microphone, an input from an electric guitar, or from a pickup attached to a musical instrument.

System 1100 is shown with an analog/digital signal generator 1102 and zero, one or more additional inputs 1104 that generate an electrical input. The electric input may be an amplified signal generated on an analog or digital synthesizer, playback from an audio recording, from a live microphone, or from a pickup attached to a musical instrument. The electrical input is input to an analog/digital filter 1106 and the output from the analog/digital filter 1106 is used to drive an EM actuator 1108 that generates a modulation signal source that feeds into a cantilever linkage element 1114. Cantilever linkage element 1114 may represents one of cantilever 706 of FIG. 7, cantilever 812 of FIG. 8, and cantilevers 912 of FIG. 9. An acoustic signal 1110 from a musical instrument, and zero, one or more additional inputs 1112, are also input to the cantilever linkage element 1114, which couples with a physical medium 1116.

As described above with respect to FIG. 10, the cantilever linkage element 1114 may include a tip, positioned at the end of a cantilever that exhibits controllable nonlinear behavior when driven by the acoustic signal 1110 and the analog/digital signal generator 1102 to interact with the physical medium 1116. The physical medium 1116 may in turn couple with an acoustic amplifier 1118 (e.g., one of soundboards 710, 816, and 916 of FIGS. 7, 8 and 9, respectively) to output sound. A transducer pickup 1120 may also couple with the physical medium 1116 and generate a feedback signal 1121 that may be input to analog/digital filter 1106. Output from the transducer pickup 1120 may also drive an audio amplifier 1122 that in turn drives a speaker 1124 to generate an audio output.

The outputs of system 1100 may be acoustic sounds, generated directly by the acoustic amplifier 1118 and/or generated by speaker 1124 as driven by the audio amplifier 1122.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween. In particular, the following embodiments are specifically contemplated, as well as any combinations of such embodiments that are compatible with one another:

(A) A modulated electromagnetic (EM) musical system includes an acoustic carrier signal source for generating an acoustic carrier signal, an EM actuator configured to generate an acoustic modulator signal, a linkage element that exhibits nonlinear behavior when mixing the acoustic carrier signal and the acoustic modulator signal, and an acoustic output coupled with the linkage element to generate acoustic modulation.

(B) In the modulated EM musical system denoted as (A), the acoustic modulation including at least one of amplitude modulation, intermodulation, and frequency modulation.

(C) Either of the modulated EM musical systems denoted as (A) and (B), further including a second EM actuator that produces a second acoustic modulator signal, and a second linkage element that exhibits nonlinear behavior when mixing the acoustic carrier signal and the second acoustic modulator signal. The second linkage element coupling with the acoustic output to generate second acoustic modulation.

(D) In any of the modulated EM musical systems denoted as (A)-(C), the acoustic carrier signal source including at least one of a string, bar, membrane or drum head, symmetric or asymmetric tuning fork, piezoelectric element, and a surface transducer.

(E) In any of the modulated EM musical systems denoted as (A)-(D), the acoustic modulator signal source comprises one or more of an EM actuator, transducer, voice-coil actuator, and a shaker.

(F) In any of the modulated EM musical systems denoted as (A)-(E), the linkage element including at least one of a cantilever, a t-frame, a baffle, and a bridge, wherein a first distance between the linkage element and the acoustic output is zero.

(G) In any of the modulated EM musical systems denoted as (A)-(F), the linkage element assembly further including a material for making continuous or intermittent contact with the acoustic output, the material being selected from the group including metal, wood, cloth, rubber, and synthetic elastic material.

(H) In any of the modulated EM musical systems denoted as (A)-(G), the acoustic output is a physical medium that converts and amplifies vibrations into acoustic waves, the acoustic output being selected from the group include solid materials in the form of soundboards, pipes, horns, membranes, planar surfaces, and fluids such as air.

(I) In any of the modulated EM musical systems denoted as (A)-(H), the acoustic output including a pickup for converting vibrations into an electrical signal for further processing and/or amplification.

(J) In any of the modulated EM musical systems denoted as (A)-(I), the acoustic output is coupled to an audio input module configured to generate a feedback signal in response to the acoustic output, wherein the feedback signal is processed to control the EM actuator to generate the acoustic modulator signal.

(K) Any of the modulated EM musical systems denoted as (A)-(J), further including a base structure having vibration absorption materials configured to isolate acoustic output from acoustic carrier signal source, the EM actuator, and the linkage element.

(L) A method modulates an acoustic carrier signal using a tipped-cantilever linkage element physically coupled to a source of the acoustic carrier signal. An EM actuator is controlled to impart an acoustic modulator signal to the tipped-cantilever linkage element and a tip of the tipped-cantilever linkage element causes a nonlinear interaction with an acoustic output to modulate the acoustic carrier signal.

(M) The method denoted as (L), the modulation being performed through transduction from EM Actuators.

(N) In either of the methods denoted as (L) and (M), the modulation resulting from nonlinear motion of a tip of the tipped-cantilever linkage element against the acoustic output.

(O) In any of the methods denoted as (L)-(N), the modulation including one or more of amplitude modulation, intermodulation, and frequency modulation.

(P) An EM musical instrument having acoustic signal modulation includes an harmonic oscillator for generating an acoustic carrier signal at an approximate harmonic frequency, a dampener positioned a first distance from the EM driven harmonic oscillator, an EM driven transducer for generating a modulation signal to control the dampener to modulate the acoustic carrier signal, and a linkage element coupling the EM driven transducer to the dampener to apply time varying contact of the dampener to the EM driven harmonic oscillator to modulate the acoustic carrier signal.

(Q) In the EM musical instrument denoted as (P), the modulation including one or more of amplitude modulation, intermodulation, and frequency modulation.

(R) Either of the EM musical instruments denoted as (P) and (Q), further including an EM driver for driving the harmonic oscillator using an electromagnetic signal to generate the acoustic carrier signal.

The invention claimed is:

1. A modulated electromagnetic (EM) musical system, comprising:

an acoustic carrier signal source for generating an acoustic carrier signal;

an EM actuator configured to generate an acoustic modulator signal;

a linkage element, driven by the EM actuator, that exhibits nonlinear behavior when physically mixing the acoustic carrier signal and the acoustic modulator signal; and an acoustic output coupled with the linkage element to generate acoustic modulation with the non-linear behavior.

2. The modulated EM musical system of claim 1, wherein the acoustic modulation comprises at least one of amplitude modulation, intermodulation, and frequency modulation.

3. The modulated EM musical system in claim 2, further comprising:

a second EM actuator that produces a second acoustic modulator signal; and a second linkage element that exhibits nonlinear behavior when mixing the acoustic carrier signal and the second acoustic modulator signal;

wherein the second linkage element couples with the acoustic output to generate second acoustic modulation.

4. The modulated EM musical system of claim 3, wherein the acoustic carrier signal source comprises at least one of a string, bar, membrane or drum head, symmetric or asymmetric tuning fork, piezoelectric element, and a surface transducer.

5. The modulated EM musical system of claim 4, wherein the acoustic modulator signal source comprises one or more of an EM actuator, transducer, voice-coil actuator, and a shaker.

6. The modulated EM musical system of claim 5, wherein the linkage element comprises at least one of a cantilever, a t-frame, a baffle, and a bridge, wherein a first distance between the linkage element and the acoustic output is zero.

7. The modulated EM musical system of claim 6, wherein the linkage element assembly further comprises a material for making continuous or intermittent contact with the acoustic output, the material being selected from the group including metal, wood, cloth, rubber, and synthetic elastic material.

8. The modulated EM musical system of claim 7, wherein the acoustic output is a physical medium that converts and amplifies vibrations into acoustic waves, the acoustic output being selected from the group include solid materials in the form of soundboards, pipes, horns, membranes, planar surfaces, and fluids such as air.

9. The modulated EM musical system of claim 8, wherein the acoustic output comprising a pickup for converting vibrations into an electrical signal for further processing and/or amplification.

10. The modulated EM musical system of claim 9, wherein the acoustic output is coupled to an audio input module configured to generate a feedback signal in response to the acoustic output, wherein the feedback signal is processed to control the EM actuator to generate the acoustic modulator signal.

11. The modulated EM musical system of claim 10, further comprising a base structure having vibration absorption materials configured to isolate acoustic output from acoustic carrier signal source, the EM actuator, and the linkage element.

12. A method for modulating an acoustic carrier signal using a tipped-cantilever linkage element physically coupled to a source of the acoustic carrier signal, the method comprising:

controlling an EM actuator to physically impart an acoustic modulator signal to the tipped-cantilever linkage element;

wherein a tip of the tipped-cantilever linkage element causes a nonlinear interaction with an acoustic output to modulate the acoustic carrier signal.

13. The method of claim 12, wherein the modulation is performed through transduction from EM Actuators.

14. The method of claim 13, wherein the modulation results from nonlinear motion of a tip of the tipped-cantilever linkage element against the acoustic output.

15. The method of claim 14, the modulation comprising one or more of amplitude modulation, intermodulation, and frequency modulation.

16. An electromagnetic (EM) musical instrument having acoustic signal modulation, comprising:

an EM driven harmonic oscillator for generating an acoustic carrier signal at an approximate harmonic frequency;

a dampener positioned a first distance from the EM driven harmonic oscillator;

an EM driven transducer for generating a modulation signal to control the dampener to modulate the acoustic carrier signal; and a linkage element coupling the EM driven harmonic oscillator to an acoustic output wherein the time varying contact of the dampener to the EM driven harmonic oscillator physically modulates the acoustic carrier signal.

17. The EM musical instrument of claim 16, the modulation comprising one or more of amplitude modulation, intermodulation, and frequency modulation.

18. The EM musical instrument of claim 17, further comprising an EM driver for driving the harmonic oscillator using an electromagnetic signal to generate the acoustic carrier signal.

* * * * *